United States Patent [19]

Beck et al.

[11] Patent Number: 4,982,662

[45] Date of Patent: Jan. 8, 1991

[54] SHAPED PRIMER

[75] Inventors: Michael W. Beck, Transvaal, South Africa; David L. Kennedy, Dundonald, United Kingdom

[73] Assignee: Imperial Chemical Industries PLC, London, England

[21] Appl. No.: 489,739

[22] Filed: Feb. 28, 1990

Related U.S. Application Data

[63] Continuation of Ser. No. 227,877, Aug. 3, 1988, abandoned.

[30] Foreign Application Priority Data

Aug. 21, 1987 [GB] United Kingdom ..... 8719846

[51] Int. Cl.[5] ..... F42C 19/09

[52] U.S. Cl. ..... 102/205; 102/322

[58] Field of Search ..... 102/306, 307, 204, 205, 102/309, 322, 476, 701

[56] References Cited

U.S. PATENT DOCUMENTS

| | | | |
|---|---|---|---|
| 42,363 | 4/1864 | Ganster | 102/205 |
| 45,806 | 1/1865 | Adams | 102/205 |
| 734,966 | 7/1903 | Schou | 102/204 |
| 1,015,945 | 1/1912 | DuPont | 102/205 |
| 1,738,402 | 12/1929 | Snelling et al. | 102/322 |
| 2,408,486 | 10/1946 | Shinkle | 102/205 |
| 3,252,418 | 5/1966 | Terrioux | 102/476 |
| 3,672,300 | 6/1972 | Axelson et al. | 102/205 |
| 4,112,847 | 9/1978 | Thomanek | 102/205 |
| 4,184,430 | 1/1980 | Mock | 102/307 |
| 4,297,946 | 11/1981 | Paton et al. | 102/307 |
| 4,425,849 | 1/1984 | Jorgenson | 102/275.12 |
| 4,765,246 | 8/1988 | Carlsson et al. | 102/322 |

FOREIGN PATENT DOCUMENTS

| | | | |
|---|---|---|---|
| 934224 | 9/1973 | Canada | 102/322 |
| 1137351 | 9/1962 | Fed. Rep. of Germany | 102/476 |
| 3436934 | 1/1986 | Fed. Rep. of Germany | 102/476 |
| 1202460 | 1/1960 | France | 102/476 |
| 1293794 | 4/1962 | France | 102/476 |
| 617835 | 2/1961 | Italy | 102/476 |
| 578995 | 7/1946 | United Kingdom | 102/476 |
| 771900 | 4/1957 | United Kingdom | 102/322 |
| 1195461 | 6/1970 | United Kingdom | 102/322 |

*Primary Examiner*—Charles T. Jordan
*Assistant Examiner*—Stephen Johnson
*Attorney, Agent, or Firm*—Cushman, Darby & Cushman

[57] ABSTRACT

A primer for explosives comprises a shaped charge of detonating material for use with an initiator such as a detonator or fuse cord which penetrates into the charge at least about as far as its center of mass, wherein said primer has a cavity for receiving said initiator and a shock attenuator in the form of an insert of inert material of lower density than the detonating material which extends from the surface of the charge into the charge to a desired detonation region and has a portion surrounding at least a part of the length of the cavity and defining an inlet for insertion of said initiating means, the density of the insert relative to the detonating material and shape thereof providing for improved detonation of the primer.

8 Claims, 2 Drawing Sheets

SHAPED PRIMER

This is a continuation of Application No. 227,877, filed Aug. 3, 1988, which was abandoned upon the filling hereof.

This invention relates to a primer or booster for explosives. More particularly the invention relates to a primer or booster of the type, typically comprising a charge of detonating material such as pentolite or the like, used to transmit a detonation from a detonator or detonating cord, to a surrounding or adjacent charge of a bulk explosive, usually in a borehole.

It has been observed that on occasions detonation does not proceed as intended and the reliability of certain existing detonation systems falls short of desired requirements. Therefore an object of the present invention is to provide an improved means of transmitting a detonation from an initiator such as fuse cord or a detonator to a bulk explosive.

Broadly the present invention fulfils this object by providing a primer for explosives which comprises a shaped charge of detonating material having a cavity therein to receive initiating means and a shock attenuator in the form of a shaped insert of inert material the density of which is less than that of the detonating material, the said insert extending from the surface of the charge into the charge to a desired detonation region and having a portion defining an inlet for insertion of said initiating means into said cavity. The density and shape of the said insert is such as to absorb or retard the progress of shock waves developing from detonation of the initiator so as to screen or shield the detonating material adjacent to the initiator and thereby avoid or reduce desensitisation of the detonating material.

More specifically, according to the present invention there is provided a primer for explosives which comprises a shaped charge of detonating material for use with initiating means which penetrates into the charge, wherein said primer has a cavity therein to receive said initiating means, and a shock attenuator in the form of an insert of inert material the density of which is less than that of the detonating material, the insert extending from the surface of the charge into the charge to red detonation region and having a portion surrounding at least part of the length of the cavity and defining an inlet for insertion of said initiating means into said cavity; the density of the insert relative to the detonating material and shape thereof providing for transmission of a detonating shock wave from initiating means penetrating into the charge to said detonation region such that the shock wave reaches the surface of the detonating material at the periphery of the insert via the detonating material before it reaches said periphery via the inert material.

Preferably the initiating means is a detonating cord and the charge is shaped to define a recess extending into the charge for receiving the end of said detonating cord. More preferably the charge is shaped to define a passage extending through the charge to allow a detonating cord to be passed from one side of the primer through to exit at the other side of the primer. Thus in either case when the detonation of the primer is initiated by the said detonating cord the detonation enters the primer via said inlet and transmits a detonating shock wave into and through the primer which, on account of the relative densities of the detonating material and shape of said insert, reaches the surface of the detonating material at the periphery of the insert along a path extending through the detonating material before it reaches said periphery along a path through the insert.

Thus the primer of this invention is characterised by a cavity extending into the charge at least as far as a central region of the primer and a shaped inert compressible insert of lower density material bounding the said cavity and extending from the periphery of the primer towards the central region to define in said primer a passage for the insertion of initiating means at least as far as said central region, said insert being effective to screen or isolate surrounding charge from shock waves emanating from said initiating means whereby desensitisation of the charge prior to detonation thereof is avoided or substantially reduced.

Although the cavity may be a recess extending, for instance, to a point in the region of the centre of mass of the charge, it is preferable for the cavity to be a passage extending through the primer since it is then easy to fix the primer onto the end of a detonating cord, by threading the cord through and tying a knot, and easy to string a number of the primers onto a single length of cord. Initiators, whether detonating cord or detonators, are in practice circular in cross-section and of uniform thickness; therfore, the cavity will in practice be straight, circular in section, and ideally be matched in width to that of the intended initiation means so that there is a reasonably close or snug fit. Plainly, if the cavity is merely a recess, there will need to be some mechanism or means deployed to attach a detonating cord or detonator to the primer, if the primer is to be handled in the field in the customary way. A clamp, snap-coupling, or friction fit are possibilities.

Typically the cavity passage will be a passage through the primer and will be straight and circular in cross-section, in which case the insert will be annular in cross-section, the said passage extending along the polar axis of the insert and the insert tapering from its periphery at the surface of the detonating material, in a direction towards the axially inner end of the insert. In particular, said tapering part of the insert may be part-ellipsoidal in shape, being part of an ellipsoid whose major axis coincides with the axis of the passage.

The detonating material of the primer typically has a density in excess of 1 $g.ml^{-1}$, say for example from 1.4 to 1.6 $g.ml^{-1}$ and it may be pentolite, in which case the inert material of the insert may have a density in the range 0.4 to 0.6 $g.ml^{-1}$, e.g. about 0.5 $g.ml^{-1}$. Suitable materials for the insert include wood, foamed plastics material, plaster of paris, etc., there being a wide variety of choices of suitable materials in this density range.

In one particular embodiment of the invention, the primer may be substantially spherical in shape, the recess or passage extending diametrically into or through the primer.

In another particular embodiment of the invention, the primer may be substantially right cylindrical in shape, of constant diameter and circular in cross-section, in which case the cylindrical shape of the primer may have an aspect ratio in the range 0.8 to 1.2, e.g. about 1.0.

When the primer is spherical or right cylindrical in shape with an aspect ratio of 1.0, the inner end of the insert may be spaced from the outlet of the passage, i.e. the end of the passage opposite the inlet end of the passage surrounded by the insert, by a spacing of 55 to 65% of the diameter of the primer. Alternatively stated, the insert has a length which extends radially inwards from the surface of the charge of about 70 to 90% of the radius of the charge.

Furthermore, the passage may have two portions of differing diameters, namely a broad portion extending inwardly from the inlet, and a narrow portion extending inwardly from the outlet, said portions intersecting at a shoulder spaced from the outlet end of the passage by a spacing of 40 to 50% of the diameter of the primer.

In use, with a detonator, the detonator will be inserted into the broad end of the passage so that its end containing its base charge abuts the shoulder.

Typically, pentolite of the like primers are capable of being initiated by either detonating cord or detonators. Accordingly, the narrower part of the passage should be of a diameter suitable for receiving, with the usual working clearance, the diameter of detonating cord usually employed, and, similarly, the broader part of the passage should be of a diameter suitable for receiving, with the usual working clearance, the diameter of detonator usually employed. Primers are usually made in a range of more or less standard sizes, with regard to the mass of their charge of pentolite or the like, and are detonated by detonating cord or detonators of standard diameters, the same standard cord or detonators being used for a range of primer sizes. Thus the diameters of the narrow and broad portions of the passage of the primer of the present invention will be more or less independent of the size of mass of the primer charge, but will instead correspond respectively with the diameters of standard detonating cords and detonators used, the detonating cord used for a particular primer charge typically being of a lower diameter than the detonators used for that primer.

Furthermore, as the lengths of detonators can vary, an annular boss may be provided at the inlet end of the primer, conveniently in the form of a tapering projection or extension of the insert, standing proud of the shaped charge of detonating material of the primer, so that the passage is long enough to receive the longest detonator, including time-delay detonators, with which the primer is expected to be used. In this way the whole of the detonator, regardless of its length, is located within the interior of the passage and is protected by the primer, while the base charge of the detonator is located more or less at the centre of the primer adjacent the shoulder in the passage. In this regard it will be noted, from the preferred dimensions described above and bearing in mind that such base charges typically have an aspect ratio of about 1, that the centre of the base charge of the detonator will be spaced from the outlet end of the passage by slightly more than 50% of the diameter of the primer. This compensates for the fact that detonators tend to propagate a detonation in a direction axially away from their end at which their base charge is located slightly faster than in the opposite axial direction.

It should also be noted that the primer will, associated with the insert, preferably be provided with a clamp or suitable fastening device for holding a detonator in position in the broad end of the passage, in abutment with the shoulder.

As will be appreciated from the geometry and dimensions of the insert and passage of the primer of the present invention described above, if a detonator is inserted into the broad inlet end of the passage into abutment with said shoulder, its base charge will be more or less at the centre of the primer, axially inwardly of the inner end of the insert, and surrounded by detonating material. Similarly, if detonating cord is inserted into the broad inlet end of the passage and thence into the narrow outlet end of the passage to project out of said outlet end to be secured there by tying a knot therein or the like, it will first come into detonating contact (in the direction of detonation along the cord) with the detonating material of the primer adjacent the centre of the primer, between the shoulder and the inner end of the insert, slightly closer to the inlet end of the passage than to the outlet end thereof.

Primers of the type in question are usually used for bottom-initiation at the bottoms of boreholes, i.e. at their blind or inner ends remote from their mouths, with a bulk charge or explosive, such as ANFO explosive, emulsion or slurry, on top of the primer and on the same side of the primer as the mouth of the borehole. Such primers are also sometimes used for mid-initiation of bulk explosive in boreholes, in which case they are located spaced from both ends of the boreholes, e.g. midway along the length of the boreholes.

The design of the primer of the present invention permits initiation of the detonation in the pentolite or like detonating material of the primer at a position close to the centre of the primer. The detonation shock wave transmitted through the pentolite will thus be transmitted in all directions from the centre of the primer to the surface of the primer, but particularly in opposite axial directions relative to the axis of the passage, through a considerable thickness of pentolite, approximating half the diameter of the primer. This detonation shock wave will thus have an adequate opportunity to intensify as it propagates through the pentolite, so that it leaves the surface of the primer and propagates into the surrounding bulk explosive with more or less equal intensity in all directions, adequate to initiate a detonation in all directions in the surrounding bulk explosive.

In particular, the detonation shock wave propagated from the centre of the primer through the pentolite towards the inlet end of the passage will travel in the axial direction through the pentolite surrounding the insert. Clearly, when the primer is detonated by a detonator, the shock wave transmitted towards the inlet end of the passage through the material surrounding the passage, will propagate more rapidly through the pentolite than through the insert, so that it reaches the pentolite at the surface of the primer at the periphery of the insert via the pentolite, before it reaches this position via the insert, which is substantially less dense than the pentolite.

The same however applies even with a detonating cord, although the detonation passing along the detonating cord enters the primer via the insert. Thus the degree of taper and the diameter (i.e. the shape) of the insert, together with the density of the insert relative to that of the pentolite or like detonating material of the primer, are selected together so that the detonating shock wave initiated in the pentolite in the narrow portion of the passage at and adjacent the shoulder between said narrow portion and the broad portion, is propagated through the pentolite and reaches any position on the interface between the pentolite and the insert along a path through the pentolite, before any shock wave transmitted directly through the material of the insert, in a radial direction, from the detonating cord located in the broad portion of the passage in the insert. Thus, in the case of detonation by detonating cord in particular, the shock wave which first reaches the outer surface of the pentolite at the periphery of the insert and the area of said surface surrounding said periphery, is a high energy shock wave intensified by passing through a considerable thickness of pentolite, approximating half the diameter of the primer. This leads, as mentioned above, to the propagation, at the inlet end of the primer in particular, of an adequately intensified detonating shock wave from the primer into the surrounding bulk explosive, and indeed radially in all directions from the primer. This permits reliable priming or boosting of bulk explosive, whether mid-initiated or bottom-initiated.

In contrast, if the insert is omitted and a constant diameter passage is employed, the pentolite is first initiated by detonating cord at or adjacent the primer surface at the inlet end of the passage. Little or no intensification of the detonation through the pentolite will thus take place at that end of the primer before the detonation is transmitted into the surrounding bulk explosive. Adequate intensification of the detonating shock wave is thus not promoted, and reliability of bottom-initiation suffers. This problem is not encountered for propagation of a detonating shock wave initiated by detonating cord from the centre of the primer towards the opposite or outlet end of the primer, as the speed of detonation through the pentolite is such that the detonation through the pentolite around the passage reaches the surface of the primer at said outlet end at substantially the same time as the detonation along the detonating cord, and is adequately intensified.

The invention will now be described, by way of example, with reference to the accompanying diagrammatic drawings, in which.

Figure 1:
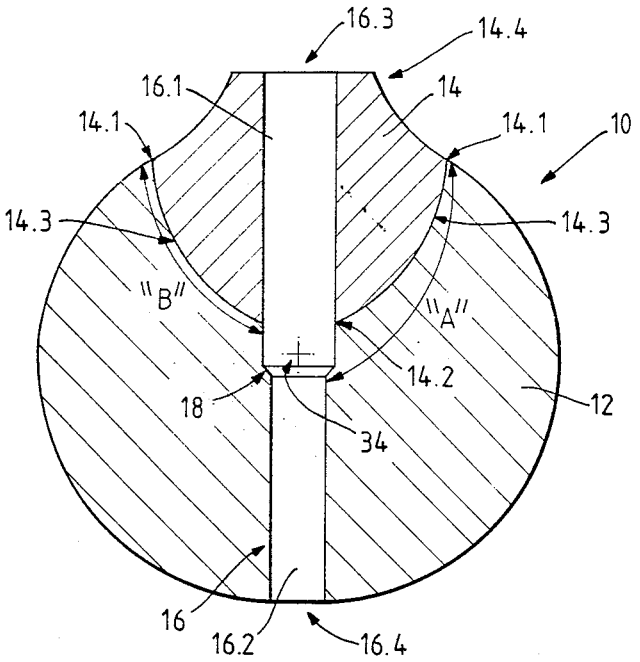
FIG. 1 shows a schematic sectional side elevation of a primer according to the invention.

With reference first to FIG. 1 of the drawings, reference numeral 10 generally designates a primer according to the invention. The primer is substantially spherical in shape, being shown more or less full size and drawn substantially to scale. It will however be appreciated that in practice its exact dimensions may vary within limits.

The primer 10 comprises a moulded pentolite charge or body 12 and a wood insert 14 of a density of 0.5 $g.ml^{-1}$. A passage 16 extends diametrically through the primer and has a broad portion 16.1 and a narrow portion 16.2, which meet at a shoulder 18.

The insert 14 tapers in an axially inward direction from its periphery 14.1 at the surface of the primer to a narrow end at 14.2. The insert, in the interior of the primer, is ellipsoidal in shape, having an elliptical axial cross-section as shown by its curved outline at 14.3.

The broad portion 16.1 of the passage extends coaxially through the insert 14. The insert 14 has a projection in the form of an annular boss 14.4 which stands proud of the spherical outer surface of the primer and which tapers outwardly from the periphery 14.1 of the insert at the surface of the primer. The end 16.3 of the passage 16 which opens out of the insert forms an inlet into the passage 16, and its opposite end 16.4 forms a outlet therefrom.

Figure 2:
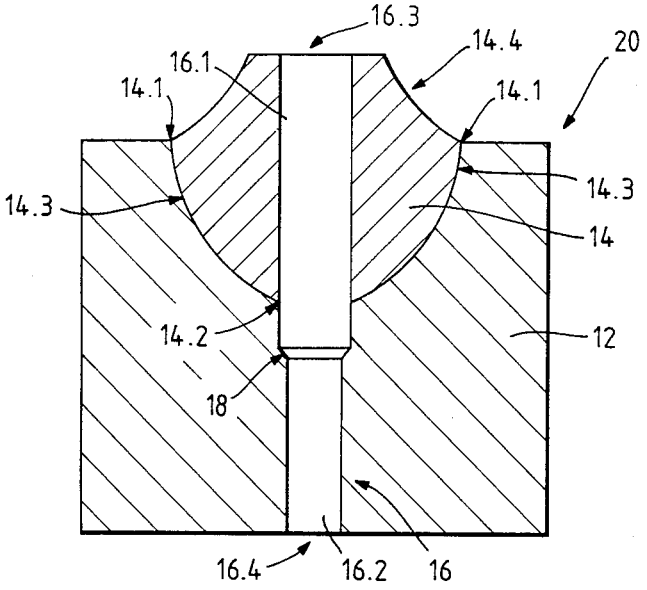
FIG. 2 shows a similar view of another primer according to the invention.

In FIG. 2 the primer is designated 20 and same reference numerals are used for the same parts as in FIG. 1, the essential difference being that, in FIG. 2, the body or charge of pentolite is moulded to be a cylinder with an aspect ratio of about 1, instead of a sphere, the passage 16 extending coaxially along the centre of the primer.

Figure 3:
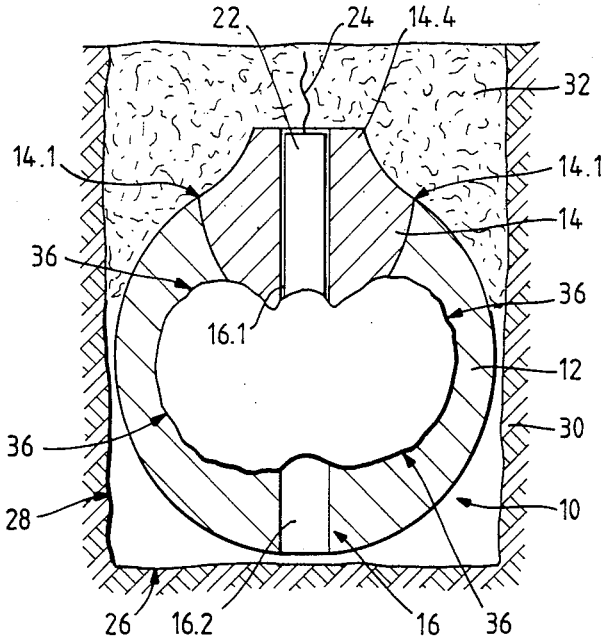
FIG. 3 shows the primer of FIG. 1 at an early stage of detonation thereof by a detonator.
Figure 4:
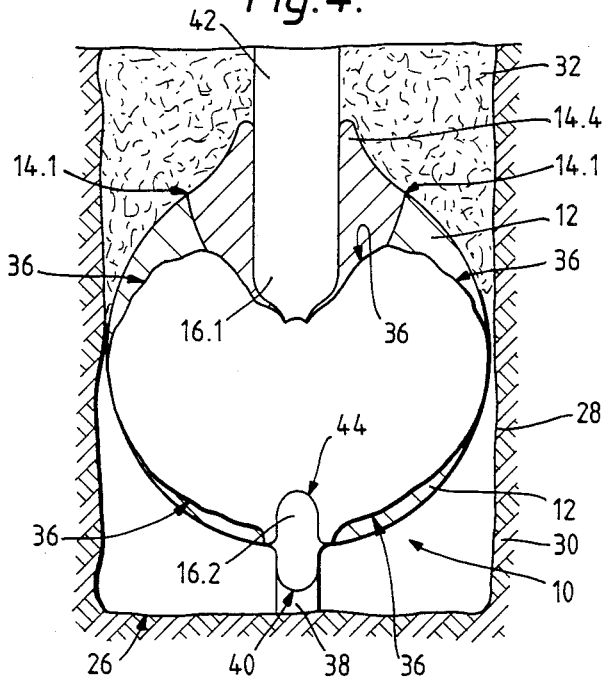
FIG. 4 shows the primer of FIG. 1 at a later stage of a detonation by detonating cord.

Without being bound by theory, the Applicant believes that the enhanced utility of the invention flowing from the construction of the primers of the present invention, arises for the reasons set forth hereunder with reference to FIGS. 3 and 4.

In use, with initiation by a detonator and with reference to FIGS. 1 and 3, the detonator 22 is inserted into the inlet 16.3 of the passage until its base abuts the shoulder 18, the detonator 22 being held in position in the broad end 16.1 of the passage 16 by a suitable clamp or like fastening device (not shown). The detonator 22 has electrical leads 24 via which it and the primer 10 are lowered with working clearance into the bottom 26 of a hole 28 bored in rock 30 to be broken. Base explosive 32 is then loaded into the borehole, on top of the primer 10. In FIG. 1 the approximate position of the centre of the base charge of the detonator in the passage 16 is shown by the cross, designated 34.

The detonator 22 is detonated electrically and transmits a detonating shock wave into the pentolite 12. In FIG. 3 what is believed will be the shape of the shock front or outline of the detonating shock wave at an early stage of detonation is shown at 36. From the shape of this wave it will be noted that it is approximately spherical and it is expected to reach the inlet end of the primer, around the periphery 14.1 of the insert 14, at more or less the same time as it reaches the surface of the pentolite elsewhere, propagating a detonation radially outwardly in all directions at more or less the same speed with the same energy and intensity.

In FIG. 4, the same reference numerals are used for the same parts as in FIG. 3, unless otherwise specified. In this case the detonator 22 is omitted and a detonating cord has instead been inserted through the inlet end 16.3 of the passage 16, via the boss 14.4, and has been passed through the narrow portion 16.2 of the passage to project from the outlet end 16.4 of the passage. A stub end of cord 38 is shown projecting out of the outlet end of the passage in FIG. 4, for ease of illustration, but in use this outwardly projecting end will usually be knotted or otherwise reliably secured, to keep the cord from pulling out of the passage 16.

In the case of FIG. 4 the situation is shown which is believed to exist when a detonation has propagated down the cord 38 and down the borehole 28, its wave front having reached the postulated position shown at 40 in the cord 38 in FIG. 4. It is believed that detonation of the cord may leave a gas space 42 in the bulk explosive 32, a gas space in the broad end 16.1 of the passage 16, which will have been expanded thereby as shown in FIG. 4, and a gas space 44 in the narrow portion 16.2 of the passage 16, most of which narrow portion will have been collapsed as shown by the expanding detonating wave 36 passing through the pentolite.

In FIG. 4, the pentolite is postulated to have been initiated first by detonating cord at the end of the narrow portion 16.2 of the passage 16 adjacent the shoulder 18 (see FIG. 1), and it is to be noted that the wave front 40 in the cord 38 is expected to be only marginally ahead of the shock wave 36 through the pentolite 12. However, at the interface between the insert 14 and the pentolite 12 the shock wave 36 passing through the pentolite is expected to travel faster towards the periphery 14.1 of the insert at the primer surface, than the shock wave (not represented in FIG. 4) passing radially through the insert. The shock wave passing through the insert is only slightly ahead of the expanding periphery of the broad portion 16.1 of the passage 16 in FIG. 4, the material of the insert being collapsed radially outwardly thereby. The wave front 36 is accordingly expected to reach said periphery 14.1 ahead of any shock wave transmitted radially through the insert 14. The annular air space which will exist around the cord 22 in the broad portion 16.1 of the passage 16, and the low density of the insert 14 will act to weaken, slow down and dissipate the radially transmitted shock wave from the cord 22 in said broad portion, so that the pentolite adjacent the surface of the insert and around the periphery 14.1 of the insert at the primer surface will not be reached by this radial shock wave, and will not be shock desensitized thereby, before said pentolite has been reached and detonated by the shock wave 36.

The shock wave 36 can thus travel the substantial distance "A" in FIG. 1, or at least the distance "B", over the ellipsoidal surface of the insert 14, to undergo substantial intensification, before it is transmitted into the bulk explosive 32. Furthermore, as is the case with FIG. 3, it will be noted that the shock wave 36 is expected to reach substantially the whole surface of the pentolite at more or less the same time, giving the primer utility for transmitting a detonation in all directions.

What we claim is:

1. A primer for use in blasting operations to initiate columns of bulk explosives which comprises:

a shaped body of detonating material with a passageway extending through the body of detonating material which provides a means for threading and suspending the primer substantially vertical onto a detonating cord, the passage of a shock attenuator insert having a length extending into the body of detonating material between 35 to 45% of an overall length of said passageway; and the insert of inert material with a density which is less than that of the detonating material, which protrudes into the shaped body of detonating material and has a centrally aligned passage that constitutes an inlet portion of the passageway; said insert being laterally enclosed by an upper portion of the body of detonating material and having a density and shape providing means for propagation of a detonating shock wave into said enclosing upper portion of said detonating material through the body of said detonating material from a cord initiation point along the passageway below the insert before a shock wave from a detonation of said detonating cord within the insert can pass laterally through the insert to the enclosing upper portion of the detonating material.

2. The primer of claim 1 wherein the passageway is straight and circular in cross-section, and the body of detonating material and the insert have a common axis of symmetry coincident with an axis of the passageway.

3. The primer of claim 2 wherein the insert fills an inwardly tapering recess in the body of detonating material that is part-ellipsoidal in shape, being part of an ellipsoid whose major axis coincides with the axis of the passageway.

4. The primer of claim 1 wherein said detonating material has a density of excess of about 1 $g.ml^{-1}$ and said insert has a density in a range from about 0.4 to about 0.6 $g.ml^{-1}$.

5. The primer of claim 1 wherein the body of detonating material is substantially spherical and the insert extends radially and axially towards a center of the body filling an inwardly tapering recess in said body.

6. The primer of claim 1 wherein the body of detonating material is substantially cylindrically shaped with an aspect ratio of from 0.8 to 1.2 and having an axis of the cylindrical body coincident with an axis of the passageway.

7. A method of initiating blastholes containing bulk explosives of one of the ANFO and emulsion method type, wherein the bulk explosive is initiated by the primer as in claim 1 that is itself initiated by the detonating cord passing through its passageway that first effects initiation of detonation of the primer centrally beyond the insert.

8. A primer for use in blasting operations to initiate columns of bulk explosives which comprises:

a shaped body of detonating material with a passageway extending through the body of detonating material which provides a means for threading and suspending the primer substantially vertical onto a detonating cord, the passageway being straight and circular in cross-section, and the body of detonating material and a shock attenuator insert having a common axis of symmetry coincident with an axis of the passageway, the insert filling an inwardly tapering recess in the body of detonating material that is part-ellipsoidal in shape, being part of an ellipsoid whose major axis coincides with the axis of the passageway; and the insert of inert material with a density which is less than that of the detonating material, which protrudes into the shaped body of detonating material and has a centrally aligned passage that constitutes an inlet portion of the passageway; said insert being laterally enclosed by an upper portion of the body of detonating material and having a density and shape providing for propagation of a detonating shock wave into said enclosing upper portion of said detonating material through the body of said detonating material from a cord initiation point along the passageway below the insert before a shock wave from a detonation of said detonating cord within the insert can pass laterally through the insert to the enclosing upper portion of the detonating material.

* * * * *